US005746429A

United States Patent [19]

Ruben

[11] Patent Number: 5,746,429

[45] **Date of Patent: *May 5, 1998**

[54] TOYS AND STORAGE DEVICE

[76] Inventor: Janet Ruben, 500 Kane Dr., Maple Glen, Pa. 19002

[ * ] Notice: The portion of the term of this patent subsequent to Aug. 17, 2013, has been disclaimed.

[21] Appl. No.: 635,617

[22] Filed: Apr. 22, 1996

Related U.S. Application Data

[63] Continuation of Ser. No. 323,823, Oct. 17, 1994, abandoned, which is a continuation of Ser. No. 107,511, Aug. 17, 1993, Pat. No. 5,360,215.

[51] Int. Cl.[6] ..... A63F 9/10

[52] U.S. Cl. ..... 273/157 R; 206/503

[58] Field of Search ..... 273/285, 287, 273/309, 153 R, 156, 157 R; 206/8, 503, 504, 508, 509, 510, 511, 512

[56] References Cited

U.S. PATENT DOCUMENTS

| | | |
|---|---|---|
| 2,534,011 | 12/1950 | Frye . |
| 2,594,628 | 4/1952 | Evans . |
| 2,986,300 | 5/1961 | Parrish . |
| 3,707,287 | 12/1972 | Spector . |
| 4,076,253 | 2/1978 | Eriksen . |
| 4,197,661 | 4/1980 | Cook et al. . |
| 4,566,130 | 1/1986 | Coates . |
| 4,960,204 | 10/1990 | Young et al. . |
| 5,062,637 | 11/1991 | Bianchi . |
| 5,238,305 | 8/1993 | Feller . |

OTHER PUBLICATIONS

Adam York Summer Catalog, "Trivia Puzzle", 1985. pp. 21.

*Primary Examiner*—William M. Pierce
*Attorney, Agent, or Firm*—Howson & Howson

[57] ABSTRACT

A combination of a plurality of toys having multiple, disengageable parts and a storage device therefor, all the parts have identifying means which make the parts of one toy distinguishable from the parts of the other toys, and the storage device has one storage compartment for each toy, each storage compartment having an identifying means which matches that of one of the toys.

5 Claims, 2 Drawing Sheets

FIG. 1
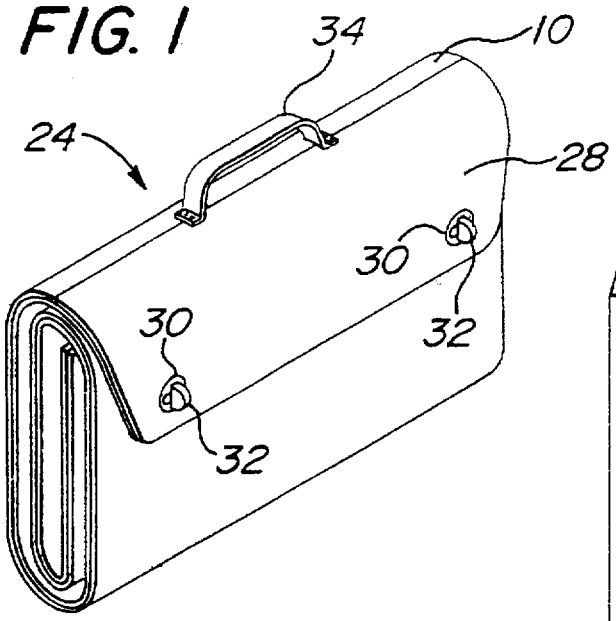
FIG. 2
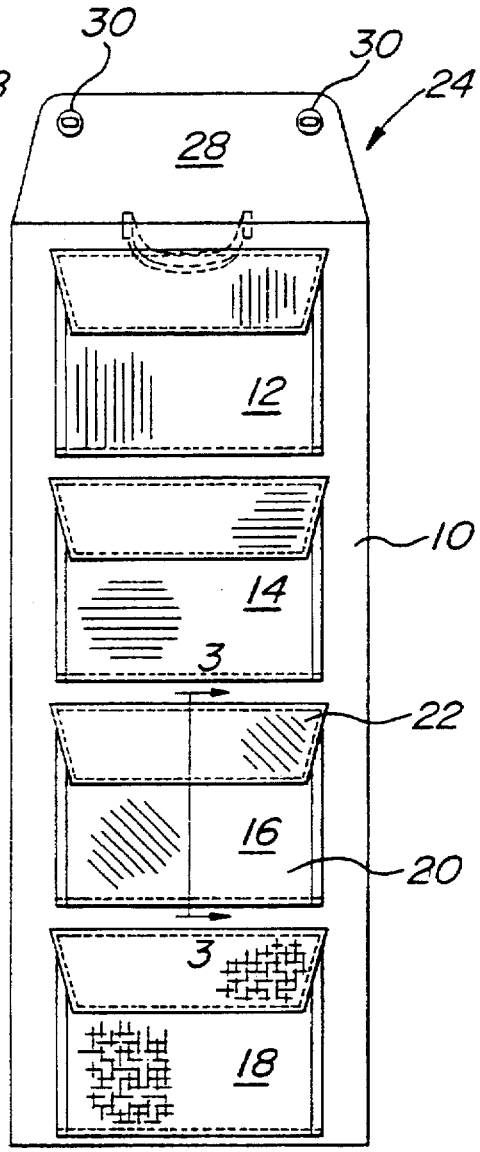
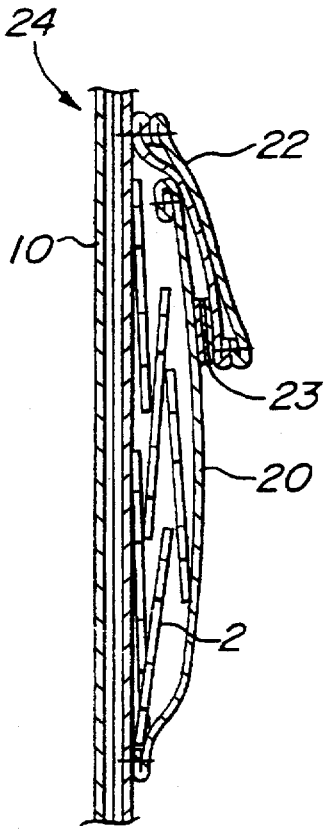
FIG. 3
FIG. 4
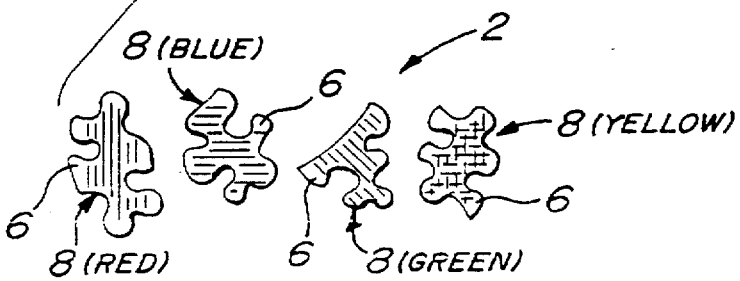

TOYS AND STORAGE DEVICE

CROSS REFERENCE TO RELATED APPLICATION

This application is a continuation of my application Ser. No. 08/323,823, file Oct. 17, 1994, now abandoned which is in turn a continuation of my application Ser. No. 08/107,511, filed on Aug. 17, 1993, now U.S. Pat. No. 5,360,215.

BRIEF SUMMARY OF THE INVENTION

This invention relates generally to toys and a storage device therefor, and more particularly, to improvements in multi-part toys to enable a child to sort the parts and stow them in containers.

Many toys are composed of multiple, disengageable parts. For instance, a single jigsaw puzzle comprises a number of disengageable puzzle pieces. With such a toy, it is very important that the disengaged parts be stored in a neat and organized manner. If multiple-part toys are not stored in an organized manner, the disengaged parts can become lost and the toy cannot be completely assembled.

A child will often play with more than one toy at a time. Disengaged parts of several toys can become mixed together, and significant effort is then required to sort the parts. Sorting the parts of several toys, e.g. jigsaw puzzles, is frequently beyond the capability of a young child.

For a long trip or a visit to a friend's house, a child may want to transport a number of toys. During travel there is an increased likelihood of losing or intermingling disengageable parts.

A series of toys can be designed which relate to a similar theme, or tell parts of the same story, or teach a lesson on the same subject. For instance, a series of puzzles can show different scenes of a particular story. Unless the series of toys is stored in an organized manner, the theme, story, or lesson will be lost.

The general object of this invention is to overcome one or more of the foregoing problems. One important specific object of this invention is to provide a series of toys having distinguishable parts such that a young child can identify the parts of a particular toy. Another object of the invention is to provide a storage device for stowing a series of multi-part toys in a neat and organized manner. Still another object of the invention is to provide a child with a series of toys which can be readily stored and carried during travel. A still further object of the invention is to provide a series of toys which are based on a similar theme, story, or lesson and stowed in the same storage device.

The invention addresses the foregoing objects by a combination comprising a plurality of toys and a storage device therefor, for use by children. Each of the toys comprises multiple, disengageable parts. Each of the parts of each of the toys bears sensorially perceptible means for identifying the part as a part of a particular toy of the plurality of toys, and for distinguishing the part from the parts of each of the other toys of the plurality of toys. For example, in the case of a series of jigsaw puzzles, the reverse side of the puzzle pieces can be color-coded. The storage device comprises a plurality of storage compartments, one for each of the toys. Each of the storage compartments has associated with it a sensorially perceptible identifying means. The identifying means associated with each of the compartments is different from the identifying means associated with each of the other compartments and corresponds to the sensorially perceptible identifying means of the parts of one of the toys. For example, the components can also be color-coded. The sensorially perceptible identifying means on each part of each toy is substantially identical to the sensorially perceptible identifying means associated with the storage compartment therefor. Each of the storage compartments is capable of containing all of the parts of the toy, the parts of which have the corresponding identifying means. After use of the toys, a child can readily place said parts of the toys in the appropriate storage compartment.

Further objects, features and advantages of the invention will become apparent from the following detailed description when read in conjunction with the drawings.

BRIEF DESCRIPTION OF THE DRAWINGS

FIG. 1 is a perspective view of a storage device in accordance with the invention, the storage device being in a condition ready to be carried;

FIG. 2 is a front elevational view of a storage device in accordance with the invention, the storage device being in a condition which allows access to the stowed toys;

FIG. 3 is a fragmentary cross section taken on plane 3—3 of FIG. 2;

FIG. 4 is a perspective view of several parts of toys having identifying means in accordance with the invention;

DETAILED DESCRIPTION

Figure 6:
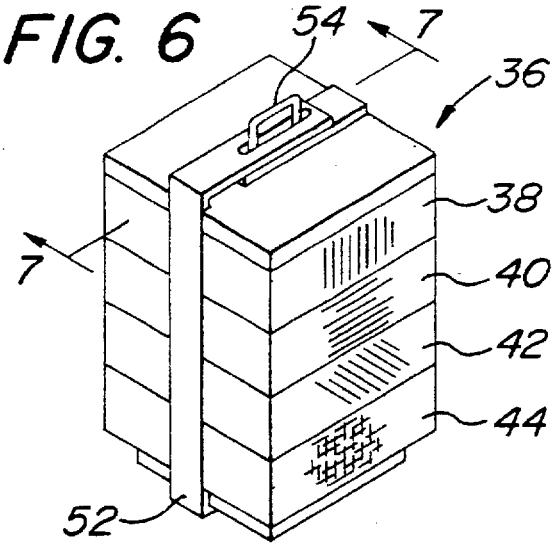
FIG. 6 is a perspective view of a storage device of FIG. 5 in a condition ready to be carried.
Figure 6:
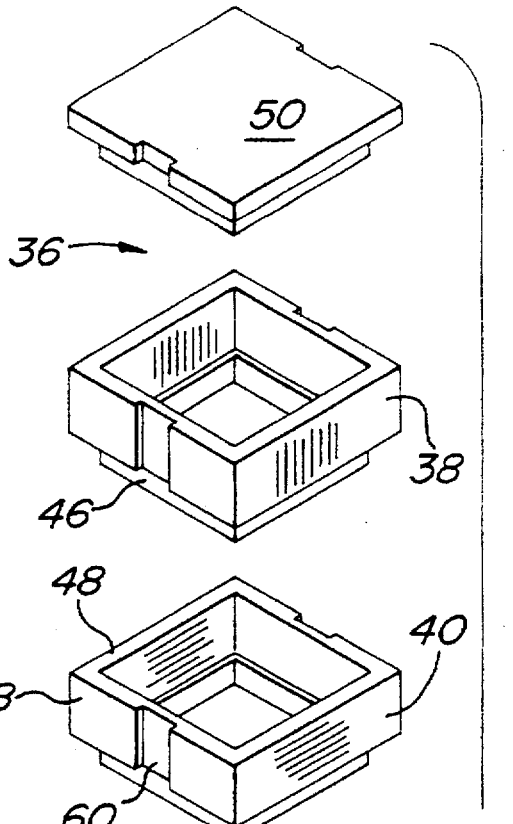

Toys in accordance with the invention are those comprising multiple, disengageable parts. FIG. 4 shows several disengaged parts 2 of jigsaw puzzles. Each of parts 2 has a front side (not shown) and a reverse side 6. Each front side bears a part of a puzzle image. Each reverse side 6 bears a sensorially perceptible means 8 for identifying the parts of a particular toy and distinguishing those parts from the parts of other toys, without the necessity for a detailed comparison of each part with the other parts of the same toy. The sensorial perceptible means 8 shown in FIG. 4 are the colors red, blue, green and yellow. All parts having a red identifying means are parts of one puzzle; all parts having a blue identifying means are parts of a second puzzle; all parts having a green identifying means are parts of a third puzzle; and all parts having a yellow identifying means are parts of a fourth puzzle. A young child is capable of separating parts having a red identifying means, for instance, from those that have a blue, green or yellow identifying means.

The storage device in accordance with the invention provides a number of storage compartments. FIG. 2 shows an embodiment of a storage device 24 comprising a one-piece sheet of fabric 10 having four storage compartments 12, 14, 16 and 18. Each storage compartment comprises a pocket 20 and a pocket flap 22. Each pocket flap 22 can be engaged with its associated pocket 20 by a fastening means 23 (see FIG. 3) such as a loop and hook fastener of the kind available under the trademark VELCRO. Other fastening means can be used such as a button and button hole, or the like. Storage device 24 also has loops 26 for hanging it from hooks on a wall so that storage compartments 12, 14, 16 and 18 are readily accessible by a young child.

Each storage compartment 12, 14, 16 and 18 has a sensorially perceptible identifying means which matches the identifying means of one of the toys. Storage compartment 12 is the color red and can hold all the parts of the toy with the identifying means of the color red. Likewise, each storage compartment 14, 16 and 18 has an identifying color which matches the identifying color of one of the toys. Each compartment is capable of containing all of the parts of one toy. The identifying means on the parts of toys and on the storage compartments allow a young child to sort and store the parts in an organized and neat manner. While the sensorially perceptible identifying means shown in FIG. 2 are colors, alternate identifying means such as patterns or textures, or combination of color, pattern or texture, can be used.

The storage device in accordance with the invention allows the stowed toys to be carried easily. The storage device 24 of FIG. 2 can be folded into the condition shown in FIG. 1. Storage device 24 has a flap 28 with elongated eyelets 30. Twistable tabs 32 and a handle 34 are connected to fabric 10 on the side opposite from storage compartments 12, 14, 16 and 18. When storage device 24 is folded in the manner shown in FIG. 1, twistable tabs 32 are engaged with elongated eyelets 30 to secure the storage device 24 in a folded condition. Handle 34 makes storage device 24 readily transportable by a young child.

Figure 5:
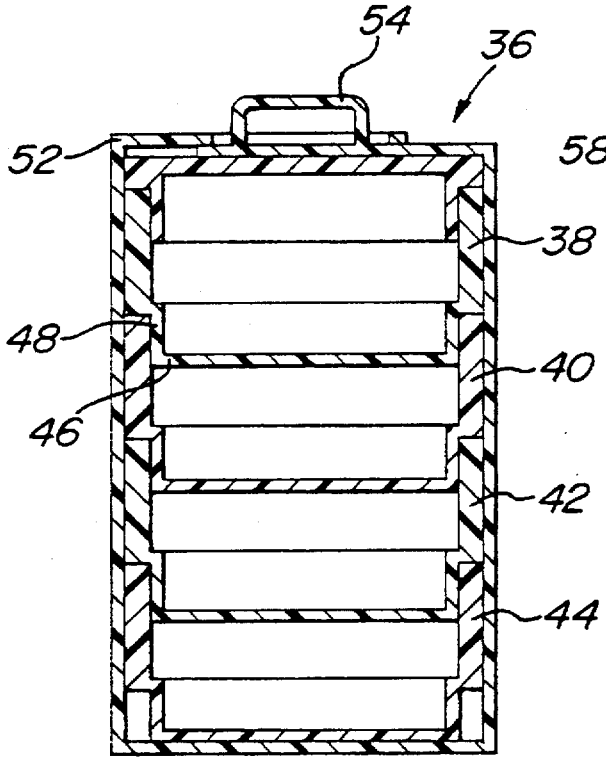
FIG. 5 is an exploded perspective view of a storage device in accordance with another embodiment of the invention.
Figure 7:
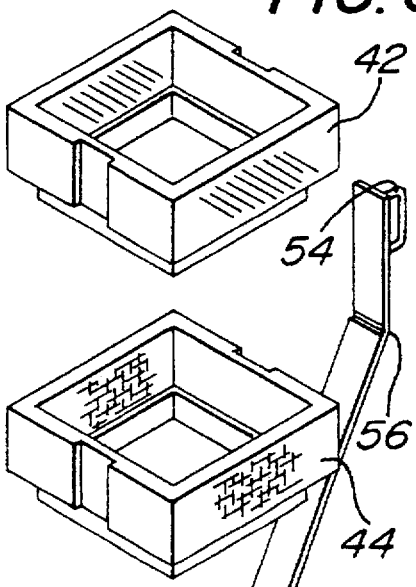
FIG. 7 is a cross section taken on plane 7—7 of FIG. 6.
Figure 7:
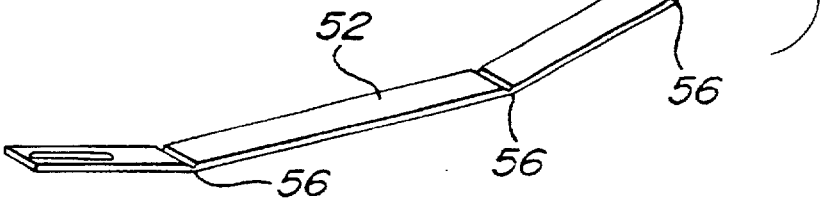

In the alternate embodiment of a storage device according to the invention shown in FIGS. 5, 6 and 7, a storage device 36 has four storage compartments 38, 40, 42 and 44. Each storage compartment is a plastic box which is nestable with the other storage compartments. Each storage compartment has a sensorially perceptible identifying means which matches the identifying means of one of the toys. The identifying means of storage compartment 38 is the color red. Storage compartment 38 can hold all the parts of the toy bearing the color red as their identifying means. Likewise storage compartments 40, 42 and 44 have color identifying means and can hold the toy having the associated identifying means.

Storage compartments 38, 40, 42 and 44 are stackable. Each storage compartment has a bottom extension 46 which mates with the top opening 48 of the adjacent storage compartment. The mating of bottom extensions 46 and top openings 48 seals the parts of the toys in the lower three storage compartments 40, 42 and 44. A top lid 50 seals storage compartment 38.

A strap 52 can secure the nested storage compartments together to provide a readily transportable storage device. Strap 52 has a handle 54 and a means for securing the ends of strap 52 together. Strap 52 is plastic, rectangular in cross section, and has four live hinges 56. The side panels 58 of storage compartments 38, 40, 42 and 44 have indentations 60 which receive strap 52 when strap 52 girds the storage compartments. With strap 52 installed, a young child can easily carry storage device 36 and the toys stowed therein.

Various modifications can be made to the toys and storage devices described above. For example, the type of toys can be multi-part figurines, automobiles, building blocks, or the like. The number of toys and storage compartments, and the type of sensorially perceptible identifying means, can also vary.

The structure of the storage device and its storage compartments can be varied. For instance, the storage device can be a bag structure with multiple sleeves defining compartments. Colors, or codes, displayed on the inside of the compartments would identify which toys belong in which compartment. The bag would close in an accordion-type manner with a single flap closing the openings of the compartments.

Still other modifications can be made to the toys and storage devices described above without departing from the scope of the invention as defined in the following claims.

I claim:

1. A combination comprising a jigsaw puzzle and a storage device therefor, for use by children, wherein:

the jigsaw puzzle comprises multiple, disengageable pieces, and each piece comprises a top face bearing a part of a puzzle image, and a bottom face bearing sensorially perceptible means for identifying said piece as a part of a particular puzzle;

the storage device comprises a storage compartment, capable of containing all of the pieces of the jigsaw puzzle, and having, on its exterior, sensorially perceptible identifying means matching the identifying means on the bottom faces of the puzzle pieces;

whereby, after use of the puzzle, a child can readily associate the pieces of the puzzles with the storage device.

2. The combination according to claim 1 in which the sensorially perceptible identifying means on both the puzzle pieces and the exterior of the storage device are selected from the group consisting of colors, patterns and textures.

3. The combination according to claim 1 in which the sensorially perceptible identifying means on the bottom face of each puzzle piece is substantially identical to the sensorially perceptible identifying means on the bottom of every other puzzle piece.

4. A combination comprising a plurality of jigsaw puzzles and a storage device therefor, for use by children, wherein:

each of the jigsaw puzzles comprises multiple, disengageable pieces, and each piece of each of the jigsaw puzzles comprises a top face bearing a of a puzzle image, and a bottom face bearing sensorially perceptible means for identifying said piece as a part of a particular puzzle of the plurality and distinguishing said piece from the pieces of each of the other puzzles of the plurality;

the storage device comprises a plurality of storage compartments, one for each of the puzzles, each of said storage compartments having associated therewith sensorially perceptible identifying means, and said identifying means associated with each of said compartments being different from said identifying means associated with each of the other compartments and corresponding to said sensorially perceptible identifying means of said pieces of one of the puzzles, and means for connecting said storage compartments together;

said sensorially perceptible identifying means on each piece of each puzzle is substantially identical to the sensorially perceptible identifying means on each of the other pieces of the same puzzle, and to said sensorially perceptible identifying means associated with said storage compartment therefor; and each of said storage compartments comprises means for enclosing all of said pieces of the puzzle having the corresponding identifying means;

whereby, after use of the puzzles, a child can readily place the pieces of the puzzles in the appropriate storage compartments.

5. The combination of claim 4, wherein each of said storage compartments comprises a rigid box, and including means for rigidly securing said storage compartments in fixed relationship to one another.

* * * * *